US011918063B2

(12) United States Patent
Hill

(10) Patent No.: US 11,918,063 B2
(45) Date of Patent: Mar. 5, 2024

(54) STRAPLESS FACE MASK

(71) Applicant: Donovan Hill, Atlanta, GA (US)

(72) Inventor: Donovan Hill, Atlanta, GA (US)

( * ) Notice: Subject to any disclaimer, the term of this patent is extended or adjusted under 35 U.S.C. 154(b) by 104 days.

(21) Appl. No.: 17/385,976

(22) Filed: Jul. 27, 2021

(65) Prior Publication Data

US 2022/0061424 A1 Mar. 3, 2022

Related U.S. Application Data

(60) Provisional application No. 63/070,296, filed on Aug. 26, 2020.

(51) Int. Cl.
*A41D 13/11* (2006.01)

(52) U.S. Cl.
CPC ..... *A41D 13/1176* (2013.01); *A41D 13/1107* (2013.01)

(58) Field of Classification Search
CPC ..... A41D 13/1107; A41D 13/1176
USPC ..... 2/9
See application file for complete search history.

(56) References Cited

U.S. PATENT DOCUMENTS 7,152,601 B2 * 12/2006 Barakat ..... A41D 13/1115 128/206.25
2003/0084903 A1 * 5/2003 Fecteau ..... A62B 18/084 128/206.27
2004/0255944 A1 * 12/2004 Griesbach, III ... A41D 13/1161 128/205.25
2006/0015988 A1 * 1/2006 Philpott ..... A42B 3/14 2/410
2006/0283454 A1 * 12/2006 Delaney ..... A41D 13/1161 128/206.28
2007/0294802 A1 * 12/2007 Lin ..... A41G 7/02 2/206
2008/0105261 A1 * 5/2008 Harold ..... A62B 23/025 128/206.13
2010/0139057 A1 * 6/2010 Soderberg ..... A43C 11/16 242/396.2
2011/0167543 A1 * 7/2011 Kovacevich ..... F16G 11/12 2/417
2011/0271955 A1 * 11/2011 Palomo ..... A41D 13/1115 128/206.16
2015/0191326 A1 * 7/2015 Hall ..... B65H 75/4431 242/396.4

(Continued)

*Primary Examiner* — Khaled Annis
*Assistant Examiner* — Dakota Marin
(74) *Attorney, Agent, or Firm* — Brennan, Manna & Diamond, LLC

(57) ABSTRACT

A strapless face mask device comprised of a hollow plastic frame that is covered by a sleeve or protective covering. The body sleeve or covering protects the face, nose, mouth and chin area of the wearer such that any respiratory droplets from the wearer are prevented from entering into the surrounding environment and potentially infecting other individuals. Further, the personal protection device has at least one and preferably two tightening mechanisms that allow a wearer to tighten or loosen the seal that the frame makes with their face. Each tightening mechanism may receive a cable that runs within the hollow frame via a spool within each mechanism. When each spool is rotated, the cable upon each spool is tightened or loosened which in turn increases or decreases the convex angle of the frame to tighten or loosen the seal of the frame against the face of the wearer.

11 Claims, 10 Drawing Sheets

(56) References Cited

U.S. PATENT DOCUMENTS

| | | | | |
|---|---|---|---|---|
| 2016/0058127 | A1* | 3/2016 | Burns | F41C 33/0209 36/58.5 |
| 2016/0270470 | A1* | 9/2016 | Hickman | A42B 3/08 |
| 2017/0347736 | A1* | 12/2017 | Penner | A42B 3/145 |
| 2017/0354540 | A1* | 12/2017 | Yang | B08B 1/006 |
| 2021/0290991 | A1* | 9/2021 | Mozayan-Isfahani | A62B 18/084 |
| 2021/0337897 | A1* | 11/2021 | Perez | A41D 13/1169 |
| 2021/0361002 | A1* | 11/2021 | Allmon | A41D 13/1115 |
| 2021/0386141 | A1* | 12/2021 | Chun | A62B 18/10 |
| 2021/0401085 | A1* | 12/2021 | Liu | A41D 13/1161 |

* cited by examiner

STRAPLESS FACE MASK

CROSS-REFERENCE TO RELATED APPLICATION

The present application claims priority to, and the benefit of, U.S. Provisional Application No. 63/070,296, which was filed on Aug. 26, 2020 and is incorporated herein by reference in its entirety.

FIELD OF THE INVENTION

The present invention relates generally to the field of personal protective equipment. More specifically, the present invention relates to a strapless face mask for use in covering the nose and mouth region of an individual. The device is comprised of a convex, hollow, flexible plastic frame that receives a sleeve to cover the frame. The sleeve covers the face, nose, mouth and chin area of the wearer such that any respiratory droplets from the wearer are prevented from entering into the surrounding environment and potentially infecting other individuals. Further, the device preferably includes one or more tightening mechanisms which allow a wearer to tighten or loosen the seal that the frame makes with the face. Each tightening mechanism may receive a cable that runs within the hollow frame via a spool within each portion of the frame. When each spool is rotated, the cable upon each spool is tightened or loosened, which in turn increases or decreases the convex angle of the frame to tighten or loosen the seal of the frame against the face of the wearer. Accordingly, the present disclosure makes specific reference thereto. Nonetheless, it is to be appreciated that aspects of the present invention are also equally applicable to other like applications, devices and methods of manufacture.

BACKGROUND OF THE INVENTION

Airborne pathogens, bacteria, and viruses spread predominately from person-to-person in the form of respiratory droplets. The droplets travel into the air when an individual coughs, sneezes, talks or breathes, and can then land on the face of another nearby person or may encounter the mouths and noses of nearby people. Therefore, if a first person is infected with a pathogen, bacteria or virus, their respiratory droplets can infect others with said pathogen, bacteria or virus. In an effort to prevent the spread of airborne pathogens, bacteria and viruses, many individuals choose to wear face masks, shields, scarves or other face coverings. As a result, wearers of face masks and other protective gear substantially reduce the amount of exhaled respiratory droplets and aerosols that leave their bodies, which in turn reduces the risk of another individual being exposed and becoming infected with a pathogen, bacteria, or virus.

Existing face masks and face coverings known in the art are often secured around the ears, neck and/or back of the head of a wearer via straps, strings or loops. However, after prolonged periods of time, said straps, loops or strings can become extremely uncomfortable and may cause irritation behind the ears, or on the neck or head. The straps, loops or strings are constantly pulling against the head, neck or ears of a wearer to keep the face mask covering a wearer's face, which can cause pressure spots to occur behind the ears, neck and on the head of the wearer. In addition, the skin behind a wearer's ears or neck can become irritated and raw, and a wearer can also develop tension headaches from the constant tension of the straps, loops or strings on their head, ears or neck after prolonged and regular face mask usage.

In addition, existing face masks offer no means for a wearer to tighten or loosen the face mask easily. As a result, individuals may wear face masks that are too tight and are therefore extremely uncomfortable, or face masks that are too loose and as a result do not properly minimize the spread of airborne pathogens, bacteria, and viruses from the wearer's respiratory droplets. Accordingly, if a wearer does wish to adjust the fit of his or her mask, he or she must resort to modifying the mask structure via replacing the straps with shorter or longer straps, or buying an additional device to place on the straps to allow for the straps to be lengthened or shortened. However, neither of said alternatives are desirable for wearers.

Further, existing face masks are not particularly stylish or visually appealing, and often only consist of one solid color mask body. However, many face mask wearers may wish to decorate their face mask with a plurality of designs, patterns, colors, logos, etc. In order to do so, a user must purchase a specifically designed mask that cannot be easily replaced if it becomes ripped, tarnished or dirtied. Therefore, from a consumer perspective, having to purchase multiple face masks to achieve multiple mask appearances is neither desirable nor economical.

Therefore, there exists a long-felt need in the art for an improved face mask. There also exists a long-felt need in the art for an improved face mask that is strapless in design and is therefore more comfortable for the wearer as it avoids the irritation which accompanies traditional face masks. Further, there exists in the art a long-felt need for an improved face mask device that allows a user to easily tighten or loosen the mask, such that it remains comfortable and properly fits to the face of the wearer to ensure adequate prevention of the passing of respiratory droplets from a wearer to others nearby. Finally, there exists a long-felt need in the art for an improved face mask that allows a wearer to easily change the appearance of the mask to ensure the mask is visually appealing.

The subject matter disclosed and claimed herein, in one embodiment thereof, comprises a strapless personal protective device. The device includes a bendable or flexible plastic frame that presses against the face of a wearer to create a seal around the nose, mouth and face area of the wearer. The frame is also secured over the nose and mouth of the wearer via a dial mechanism which allows the wearer to tighten or loosen the seal against the face. Further, the plastic frame may receive a sleeve or other covering that serves as a mask shield or facial covering. The sleeve or facial covering may further be comprised of a plurality of logos, emblems, patterns, designs, colors, jewels, etc. to accommodate the personal style and preference of the wearer.

In this manner, the strapless personal protection device of the present invention accomplishes all of the forgoing objectives while providing an improved face mask, covering or shield. Accordingly, the mask eliminates the traditional usage of straps, strings, cords or bands from existing face masks, which can become extremely uncomfortable, irritate the skin of the wearer and potentially cause tension headaches. Further, the strapless personal protection device of the present invention allows the mask to be loosened or tightened on the face of the wearer, which cannot be easily done with existing face masks without the modification of the mask or the purchase of an additional product. Finally, the strapless personal protection device of the present invention allows a user to adorn the device with a plurality of mask sleeves or coverings of differing appearances, therefore assuring the device is visually appealing.

SUMMARY OF THE INVENTION

The following presents a simplified summary in order to provide a basic understanding of some aspects of the disclosed innovation. This summary is not an extensive overview, and it is not intended to identify key or critical elements or to delineate the scope thereof. Its sole purpose is to present some general concepts in a simplified form as a prelude to the more detailed description that is presented later.

The subject matter disclosed and claimed herein, in one embodiment thereof, comprises a strapless personal protection device. The device includes a hollow, tubular, flexible plastic frame that receives a cloth sleeve or covering which protects the face, nose, mouth and chin area of the wearer. In differing embodiments of the device, the covering or sleeve may have a plurality of patterns, logos, emblems, images, symbols, designs, letters, words, characters, animals, advertisements and combinations thereof. Further, the front surface of the covering or sleeve may have a plurality of three-dimensional jewels or other decorative elements.

The personal protection device also includes a tightening mechanism that is located on each side of the device and may attach to the face of the wearer via an adhesive layer. Each mechanism has a body which houses a spool that rotates on a central shaft, and the shaft can be rotated via a dial head or other controller. Each spool further receives a cable or string which runs throughout the hollow plastic frame such that the cable forms a loop within the device. A user turns each spool in a clockwise or counterclockwise direction to lengthen or shorten the internal cable. To this effect, the lengthening or shortening of the cable allows the frame of the device to be bent or flexed in a more convex or less convex shape, such that it forms a tighter or looser seal against the face of the wearer depending on the contours of the face as well as the size of the individual's head.

As such, the strapless face mask of the present invention is particularly advantageous as it allows a wearer to adjust the tightness of the face mask via a degree of adjustability not possible with existing face masks and hence provide greater comfort to the user. Further, the strapless personal protection device of the present invention provides a more comfortable face mask design that does not utilize ear loops, bands, strings or straps, which can cause skin irritation and tension headaches. In addition, the sleeve or covering for the frame of the device allows the mask body to be easily customized to fit the contours of the face and always remain visually appealing.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE INVENTION

Figure 1A:
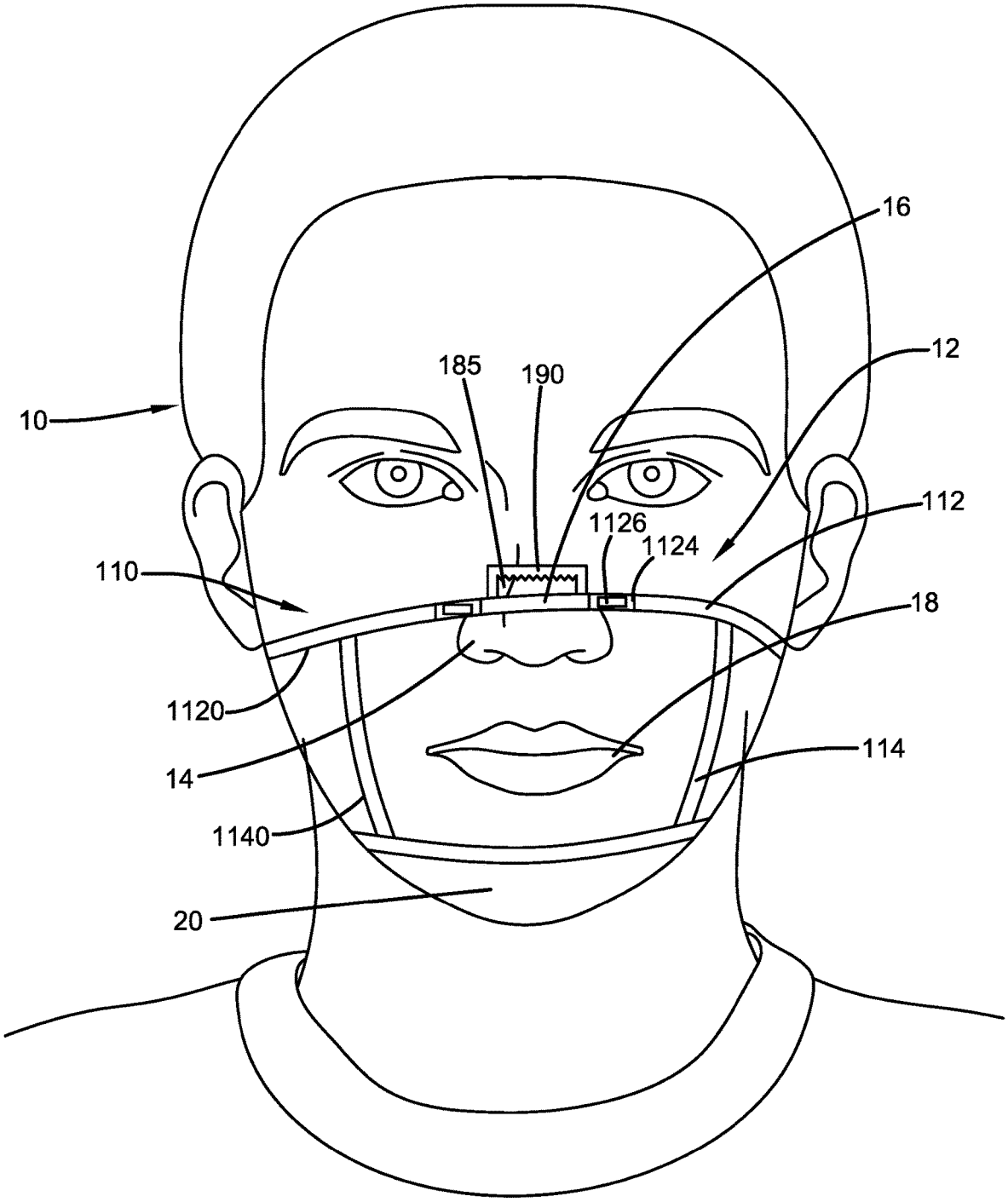
FIG. 1A illustrates a front perspective view of one potential embodiment of a frame of the strapless personal protection device of the present invention being worn by a wearer in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long-felt need in the art for an improved face mask device. There also exists a long-felt need in the art for an improved face mask that is strapless in design, which in turn makes the mask more comfortable than existing masks that use straps, loops, bands or strings to secure the mask to the face or head of the wearer. There also exists in the art a long-felt felt need for an improved face mask device that allows a user to easily tighten or loosen the mask, such that the mask remains comfortable and properly fit to his or her face to ensure the prevention of the passing of respiratory droplets by the wearer. Therefore, droplets that may contain pathogens, bacteria, and viruses are not passed from the wearer to other nearby individuals who then may become infected. Finally, there exists a long-felt need in the art for an improved face mask or personal protection device that allows a user to easily change the appearance of the mask to ensure the mask is visually appealing.

The present invention, in one exemplary embodiment, is comprised of an improved face mask or personal protection device. The device has a hollow, tubular plastic frame that includes a plurality of horizontal and vertical frame members that receive a cloth body sleeve or covering. The cloth body sleeve or covering protects the face, nose, mouth and chin areas of the wearer to prevent respiratory droplets from the wearer from entering into the surrounding environment. In differing embodiments of the device, the body sleeve may have a plurality of patterns, logos, emblems, images, symbols, designs, letters, words, characters, animals, advertisements or combinations thereof. Further, the front surface of the body sleeve or covering may have a plurality of three-dimensional jewels, stars or other decorative elements. Therefore, the body sleeve or covering allows a user to greatly customize the appearance of the personal protection device or face mask and ensure it is always visually appealing.

The device also includes a tightening mechanism that is located on each side of the device and may attach to the face of the wearer via a non-allergenic or hypoallergenic adhesive layer which may be provided in the form of a tape. The mechanism includes a body which houses a spool that rotates on a central shaft, which can be rotated via a dial head or other controller. Each spool further receives a cable which runs throughout the hollow plastic frame such that the cable forms a loop within the frame of the device. Therefore, a user may turn each spool or spindle in a clockwise or counterclockwise direction to lengthen or shorten the internal cable. To this effect, the lengthening or shortening of the cable allows the frame or portions of the personal protection device to be bent or flexed in a more convex or less convex shape such that it forms a tighter or looser seal against the face of the wearer.

Referring initially to the drawings, FIG. 1A illustrates a front perspective view of one potential embodiment of a frame of the strapless personal protection device or face mask 100 of the present invention being worn by a wearer 10 in accordance with the disclosed architecture. More specifically, the strapless face mask or personal protection device 100 has a frame 110, a body sleeve or covering 130, and preferably two tightening mechanisms 150. As shown, the frame 110 of the device 100 is worn on the face 12 of a wearer 10. It is contemplated that in the preferred embodiment of the device 100, the device 100 covers the nose 14, mouth 18, and face 12 area of the wearer 10 when worn. However, differing embodiments of the device 100 may cover any combination of the nose 14, mouth 18 and face 12 area of the wearer 100 (ex. wherein the device 100 covers only the nose 14 of the wearer 10, or only the mouth 18 of the wearer 10).

Figure 1B:
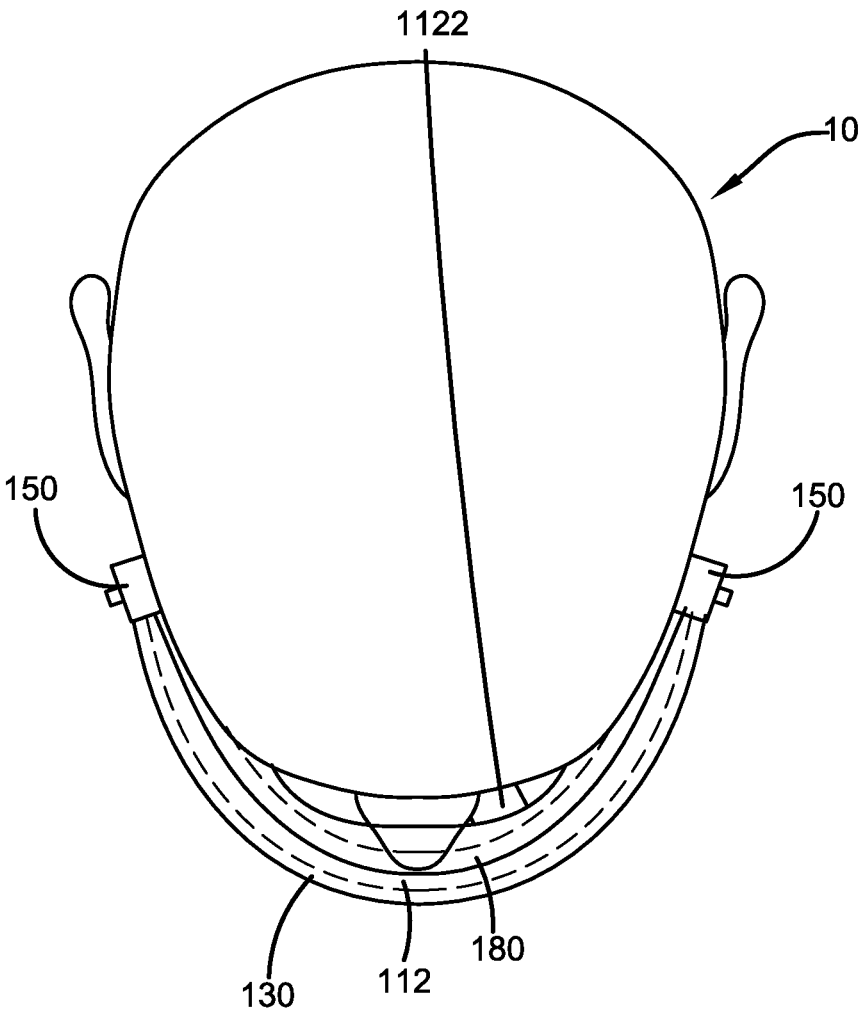
FIG. 1B illustrates a top perspective view of one potential embodiment the strapless face mask of the present invention being worn by a wearer in accordance with the disclosed architecture.

The device 100 is also preferably constructed from a hollow, tubular plastic frame 110. It is contemplated that the frame 110 has two main horizontal frame members 112 which may rest above or on the bridge 16 of the nose 14 of the wearer 10 and on the front or sides of the chin 20 of the wearer 10. Both horizontal frame members 112 are preferably convex in shape in relation to the curvature of the face 12 of the wearer 10, as best seen in FIG. 1B which illustrates a top perspective view of one potential embodiment of a strapless face mask or personal protection device 100 of the present invention while worn by a wearer 10. In an alternative configuration, portions of the horizontal frame members 112 may be straight and other portions may provide a bending or flexing area as will be described in connection with FIGS. 5A and FIG. 5B infra. In this manner, the frame 110 mirrors the relative convex shape (e.g. the convex shape can be observed when viewing the frontal plane of the head of the wearer 10 from above as shown in FIG. 1B) of the wearer's face 12 such that the rear surface 1120 of each horizontal frame member 112 rests on the face area 12, nose 14 and chin 20 of the wearer 10. In differing embodiments of the device 100, the horizontal frame members 112 may be flexible, semi-rigid or rigid to perform as will be explained more fully below. Further, in one embodiment the device 100 may also be comprised of one horizontal frame member 112

Figure 2:
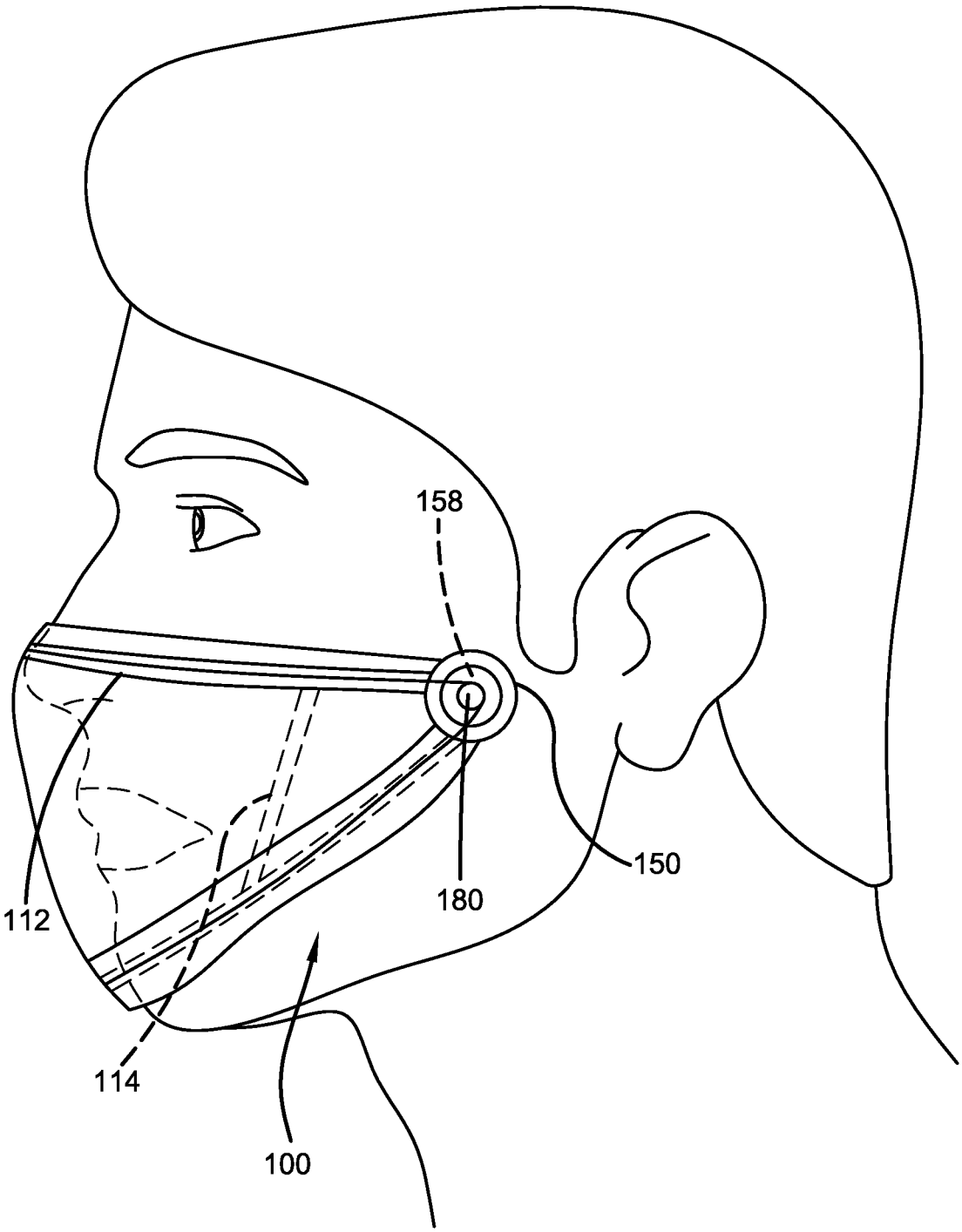
FIG. 2 illustrates a side perspective view of one potential embodiment of the strapless face mask of the present invention being worn by a wearer in accordance with the disclosed architecture.

It is further contemplated that both horizontal frame members 112 may be connected to one another via any number of fixedly-attached vertical frame members 114. The vertical frame members 114 may be flexible, semi-rigid or rigid, and may be tubular or non-tubular in differing embodiments of the personal protection device 100. In addition, the vertical frame members 114 may also be convex such that they mirror the convex shape of the face 12 of the wearer 100 (e.g. the convex shape can be observed when viewing the front plane of the head of the wearer 10 from above as shown in FIG. 1B). However, the rear surface 1140 of each vertical frame member 114 may or may not come into contact with the face 12 of the wearer 10. Therefore, an embodiment of the device 100 where the vertical frame members 114 do not contact the face 12 of the wearer 10 and may allow the wearer 10 to easily talk or breathe, without the body sleeve or covering 130 of the device 100 obstructing (e.g. making direct contact with) the mouth 18, as shown in FIG. 2 which illustrates a side perspective view of one potential embodiment of a strapless face mask or personal protection device 100 of the present invention while worn by a wearer 10. Further, the vertical frame members 114 add structural reinforcement to the frame 110, and may be fixedly attached to each horizontal frame member 112 during the manufacturing process (e.g. via injection molding, blow molding or 3D additive printing which can be used to accommodate different facial features of an individual). It is also contemplated that in at least one embodiment of the device 100, the rear surface 1120 of the horizontal frame members 112 and the rear surface 1140 of the vertical frame members 114 may be coated with a non-irritating, skin-safe adhesive compound that allows the frame members 112, 114 to safely stick to the face 12 and skin of the wearer 10. Further, one embodiment of the device 100 may be comprised of no vertical frame members 114.

In addition, it is contemplated that the horizontal frame members 112 and vertical frame members 114 may be manufactured from any number or derivative form of plastic materials that may be rigid, semi-rigid or flexible, such as but not limited to: acrylic, polycarbonate, polyethylene, thermoplastic, acrylonitrile butadiene styrene, low density polyethylene, medium density polyethylene, high density polyethylene, polyethylene terephthalate, polyvinyl chloride, polystyrene, polylactic acid, acetal, nylon, fiberglass and combinations thereof. Furthermore, the vertical frame members 114 may be connected to the top-most (e.g. nearest to the nose 14 of the wearer 10) horizontal frame member 112 via a hinge 1128 that allows the vertical frame members 114 to pivot outwards away from the face 12 of the wearer 10 or inwards toward the face 12 of the wearer 10. In this manner, the vertical frame members 114 can be pivoted outwards when the device 100 is in use to keep the covering 130 out of the mouth 18 area of the wearer 10 while talking. When not needed, the vertical frame members 114 can be pivoted inwards toward the face 12 of the wearer 10 and stored within the top-most horizontal frame member 112. In an embodiment of the device 100 with two or more horizontal frame members 112, the other frame members 112 (excluding the top-most member 112 near the nose 14 of the wearer 10) may also be connected to the vertical frame members 114 via a hinge 1128 that allows the horizontal frame members 112 to pivot in the same manner as the vertical frame members 114. Further, the other horizontal frame members 112 can also be stored within the top-most horizontal frame member 112 when they are unneeded or undesired to keep the covering 130 out of the mouth 18 area of the wearer 10 while talking.

Figure 3A:
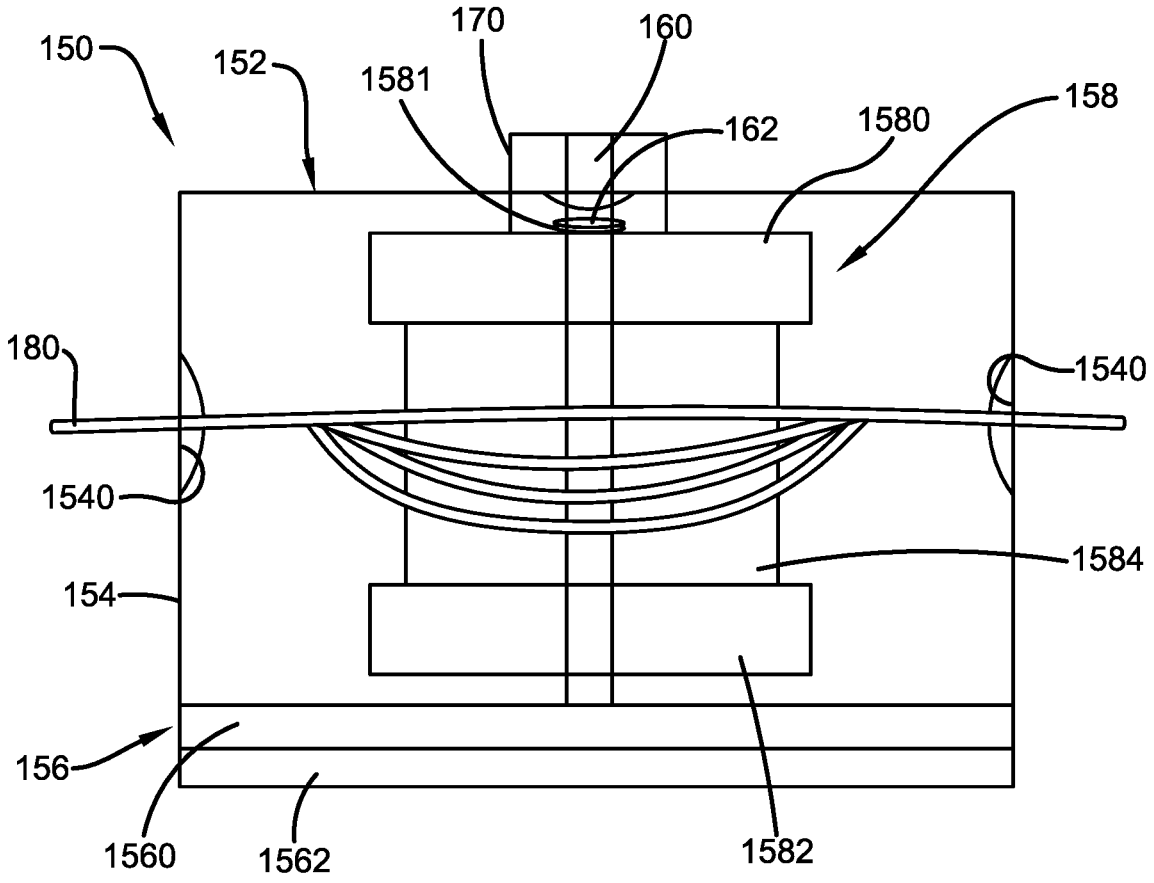
FIG. 3A illustrates a cross-sectional view of one potential embodiment of a tightening mechanism of the strapless personal protection device of the present invention in accordance with the disclosed architecture.
Figure 3B:
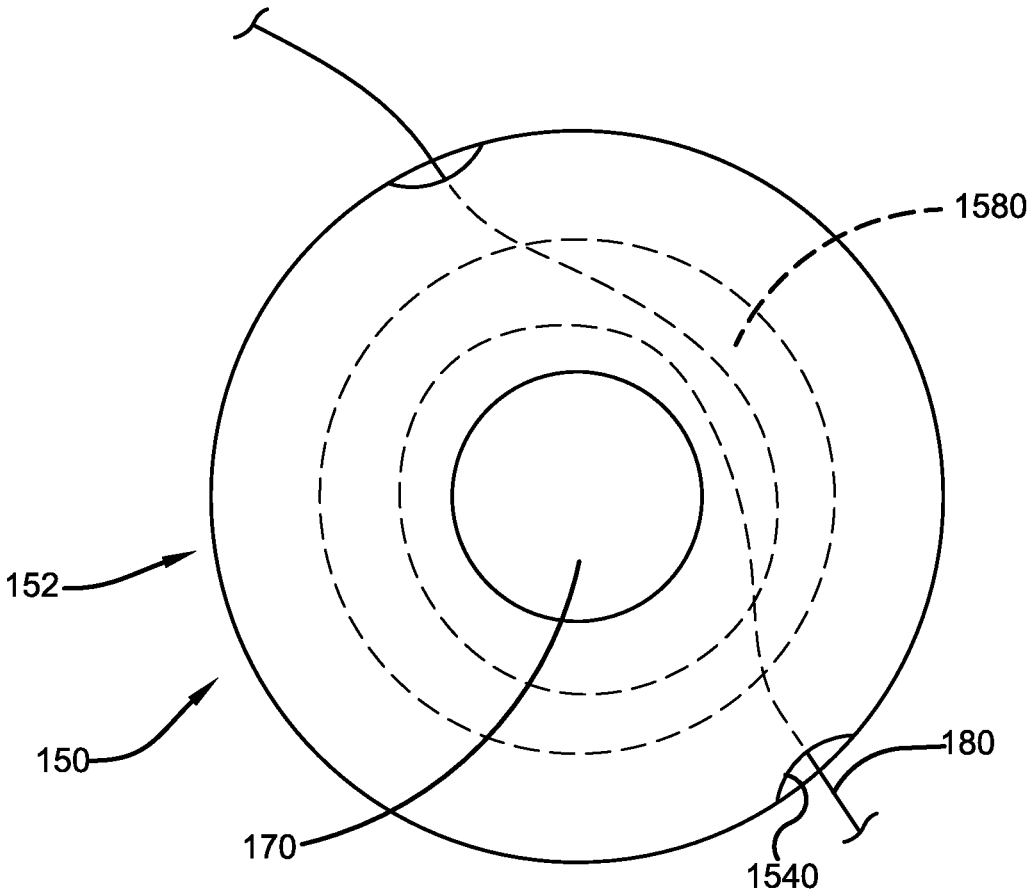
FIG. 3B illustrates a top perspective view of one potential embodiment of the tightening mechanism of the strapless personal protection device of the present invention in accordance with the disclosed architecture.

Each horizontal frame member 112 is further attached to a tightening mechanism 150. The face mask or personal protective device 100 is preferably comprised of at least one tightening mechanism 150 and preferably two tightening mechanisms 150. Each tightening mechanism 150 is located on one side of the wearer's face 12 (as can be seen in FIG. 1B) and is attached to the wearer's face 12 via a skin-safe, non-irritating hypoallergenic adhesive layer or tape 1560 which may also contain a peelable backing 1562. However, in a differing embodiment the device 100 may not be comprised of an adhesive layer 1560, and may simply be held in place on the face 12 of the wear via the compression forces generated by the horizontal frame member(s) 112 which are transmitted through each mechanism 150 and into the face 12 of the wearer. Each mechanism 150 is also made from a generally circular body 152 that is preferably some form of rigid plastic. The body 152 further houses a plurality of internal components that includes a spool 158 and central shaft 160. As seen in FIG. 3A which illustrates a cross-sectional view of one potential embodiment of a tightening mechanism 150 of a strapless face mask or personal protection device 100 of the present invention. The generally round spool 158 has a round top surface 1580 and round bottom surface 1582 that extend over (e.g. are longer in width or height) a round middle surface 1584, and a central shaft 160 that runs through all three surfaces 1580, 1582, 1584. The middle surface 1584 of the spool 158 then receives a cable 180 which enters and exits the frame body 152 via two continuous openings 1540 on the side surface 154 of the body 152 as seen in FIGS. 3A and 3B, which illustrate a cross-sectional view and top perspective view of one potential embodiment of a tightening mechanism 150 of a strapless face mask device. Further, in one embodiment the mechanism 150 may include at least one button (e.g. at least one button on each mechanism 150) that allows a user to activate the mechanism 150.

As also shown in FIG. 2, the cable 180 runs through each hollow horizontal frame member 112 and around each spool 158. The cable 180 may also be received within the frame members 112 via a groove or channel. Furthermore, wearer 10 may use the circular dial head or other controller 170 of each tightening mechanism 150 to spin the central shaft 160 in a clockwise or counterclockwise direction. To this effect, each spool 158 will rotate to increase or decrease the length of the cable 180 within the frame members 202 and within each spool 158. Therefore, if a wearer 10 turns the dial head 170 in a clockwise direction, the cable 180 may tighten (e.g. and will rotate around the spool 158 and become shorter). This will then cause the frame members 112 to bend or flex at a greater convex angle, and therefore create a tighter seal on the face 12 of the wearer 10, as seen in FIG. 1B. In contrast, a user may turn the dial head or controller 170 in a counterclockwise direction, and the cable 180 may loosen (e.g. will become unraveled from the spool 158 and become longer). This will then cause the frame members 112 to bend at a lesser convex angle and therefore create a looser seal on the face 12 of the wearer 10. Accordingly, this tightening or loosening of the cable 180 within the frame members 112 allows a wearer 10 to adjust the fit and seal of the device 100 upon the face 12. It is also contemplated that the cable 180 may include, but is not limited to: a metal-braided cable, a nylon cable, a polyvinylidene fluoride cable, a polyethylene cable, a string or the like. Further, the central shaft 160 may have a plurality of locking gears 162 that engage gears 1581 on the top surface 1580 of the spool 158. This then allows the shaft 160 to be locked at a specific tightness (e.g. specific cable 180 length) to ensure the fit and seal of the device 100 does not loosen or tighten unintentionally over time when worn by a wearer 10. In addition, the cable 180 may also be a plurality of interconnected cables instead of one singular cable 180. However, in an additional embodiment the cable 180 may be in the form of two cables that engage via a belt-like structure (e.g. wherein one cable has continuous openings that can be engaged by a male member of the other cable) to allow the device 100 to be adjusted in regards to how it fits the face of the wearer.

Figure 1C:
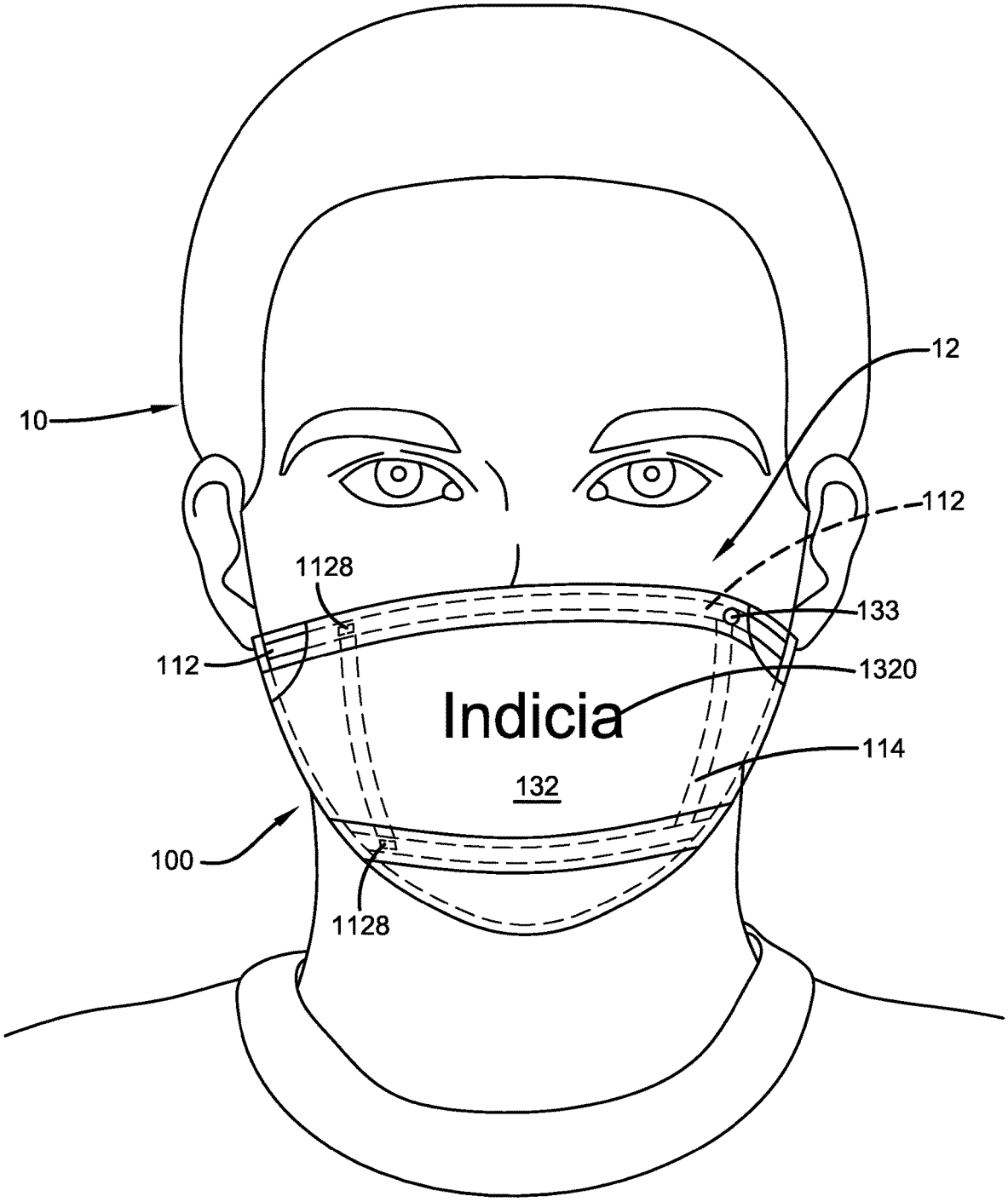
FIG. 1C illustrates a front perspective view of one potential embodiment of the strapless personal protection device of the present invention being worn by a wearer in accordance with the disclosed architecture, wherein the main horizontal frame members are clearly shown and the device further comprises a logo.
Figure 4:
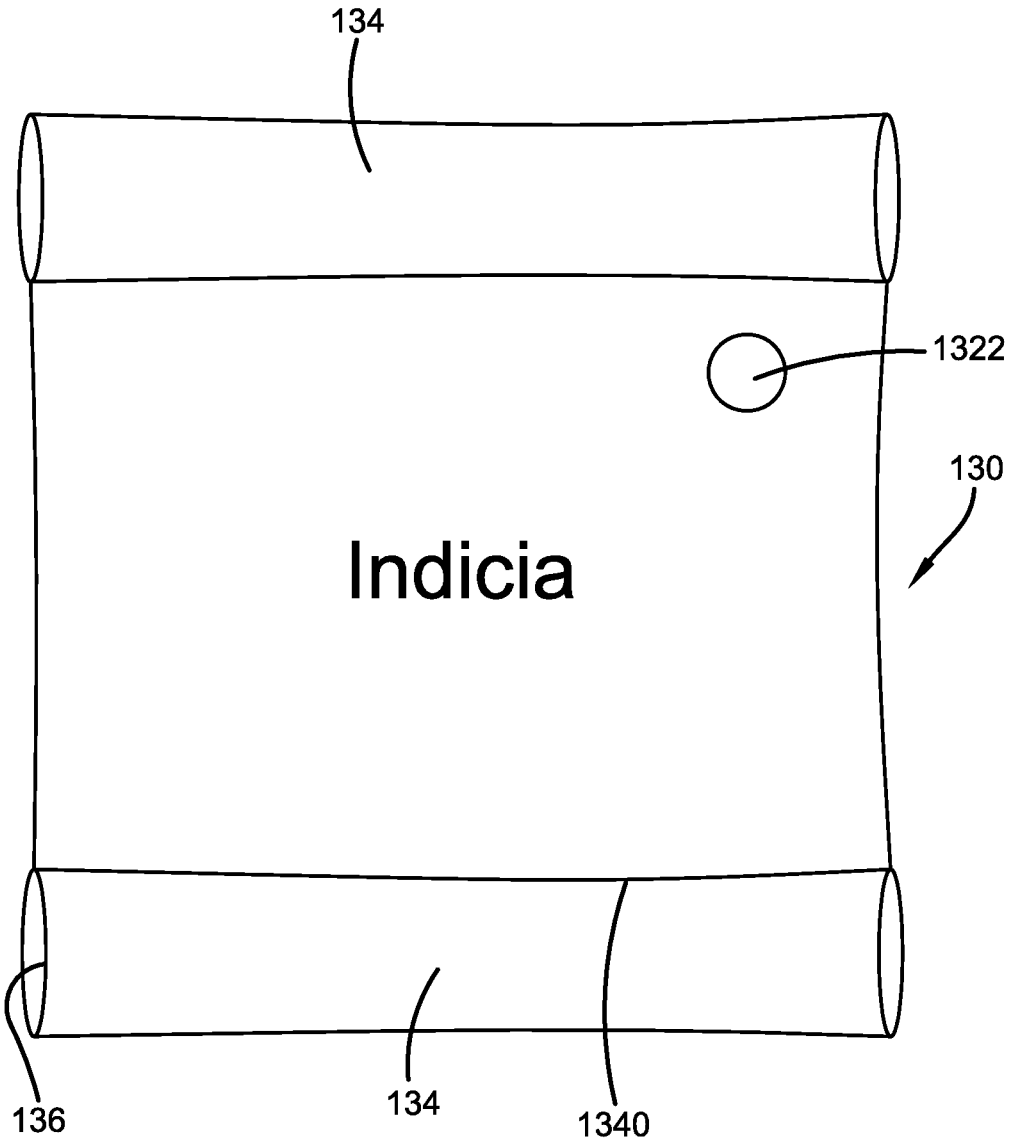
FIG. 4 illustrates a front perspective view of one potential embodiment of a body sleeve of the strapless personal protection device of the present invention in accordance with the disclosed architecture.

The device 100 also has a body sleeve or covering 130, as seen in FIG. 4 which illustrates a front perspective view of one potential embodiment of a body sleeve 130 of a strapless face mask or personal protective device 100 of the present invention. The body sleeve or covering 130 is preferably made from an organic, non-organic, or semi-organic material anti-microbial/anti-bacterial such as but not limited to: canvas, cashmere, chenille, chiffon, cotton, damask, jersey, lace, linen, wool, modal, polyester, satin, silk, spandex, suede, tweed, twill, velvet, acrylic, modacrylic, nylon, polypropylene, polyurethane, polyvinyl chloride, polyethylene, vinylidene, benzoate, aramid, rayon, acetate, triacetate or any combination thereof. The sleeve 130 further includes a plurality of internal pockets 134 that may be formed by a plurality of seams 1340 within the body sleeve or covering 130. Accordingly, the internal pockets 134 may receive the horizontal frame members 112 via a plurality of continuous openings 136 such that the sleeve 130 covers the frame 110 and therefore covers or protects the nose 14, mouth 18, face 12 and chin 20 area of the wearer 10 as shown in FIG. 1C, which illustrates a front perspective view of one potential embodiment of a strapless face mask or personal protection device 100. The front surface 132 of the sleeve 130 may further include a plurality of indicia 1320, which may include but is not limited to patterns, logos, emblems, images, symbols, designs, letters, words, characters, animals, advertisements, etc. Further, the front surface 132 may be comprised of a plurality of three-dimensional jewels 1322 or other decorative elements. Accordingly, it is contemplated that in one embodiment of the personal protect device 100, multiple differing body sleeves or coverings 130 (e.g. of differing visual designs) may be included with the device 100 in kit form. In this regard, a wearer 10 can easily change which body sleeve 130 is on the device 100 based on their tastes, preferences, occasion, etc.

One embodiment of the covering 130 may further be comprised of cutouts 131 (e.g. continuous openings) located on the upper corners of the body 130 that expose the horizontal frame member 112. In this regard, the frame member 112 can easily be removed from the covering 130 as needed. It is also contemplated that the covering 130 may attached to the horizontal frame member(s) 112 via a snap button assembly 133 that allows the covering to be snapped or unsnapped from the frame member 112 easily. In any given embodiment, the device 100 may be comprised of any number of snap button assemblies 133 positioned on any surface of the frame member(s) 112 or covering 130. In addition, the snap button assembly 133 may be located near each tightening mechanism 150.

As noted, an embodiment of the device 100 can be comprised of one horizontal frame member 112 near the nose 16 of the wearer 10. In this embodiment, the covering 130 rests on the face 12 and/or chin 20 of the wearer 10 and is held against the face 12 or chin 20 via a tension force that is created via the frame member 112. In this regard, the covering 130 can be more easily removed from a singular horizontal frame member 112 than in an embodiment with two horizontal frame members 112. It is also further contemplated that this embodiment has no vertical frame members 114, and that the tightening mechanism 150 is non-adjustable.

In addition, the device 100 may be comprised of an anti-fogging mechanism that reduces fogging when wearing the device 100 with eyewear. The mechanism is comprised of a thin, inflatable rubber cushion 1122 that can be inflated/deflated by tightening or loosening the cable 180. Further, the horizontal frame members 112 may be comprised of a plurality of shuttered continuous openings 1124, wherein the shutters 1126 of the openings can be opened/closed via the tightening or loosening of the cable 180 to allow for air to exit the mask 100 to prevent fogging of eyeglasses. Another embodiment of the anti-fogging mechanism may be comprised of a plurality of bristles 185 that are fixedly or removable attached to the horizontal frame member 112 (as seen in FIG. 1A) that engage the nose 14 of the wearer 10, wherein the bristles 185 effectively prevent air from traveling towards the nose 14 and more precisely seal and contact the nose 14 of the wearer than existing face masks known in the art. For comfort, the bristles 185 may also be covered with a soft, fabric sheath 190 wherein the fabric may be filter-based or have filtering and/or anti-microbial properties. In this manner, the bristles 185 further prevent the fogging of any eyewear worn by the wearer 10.

Figure 5A:
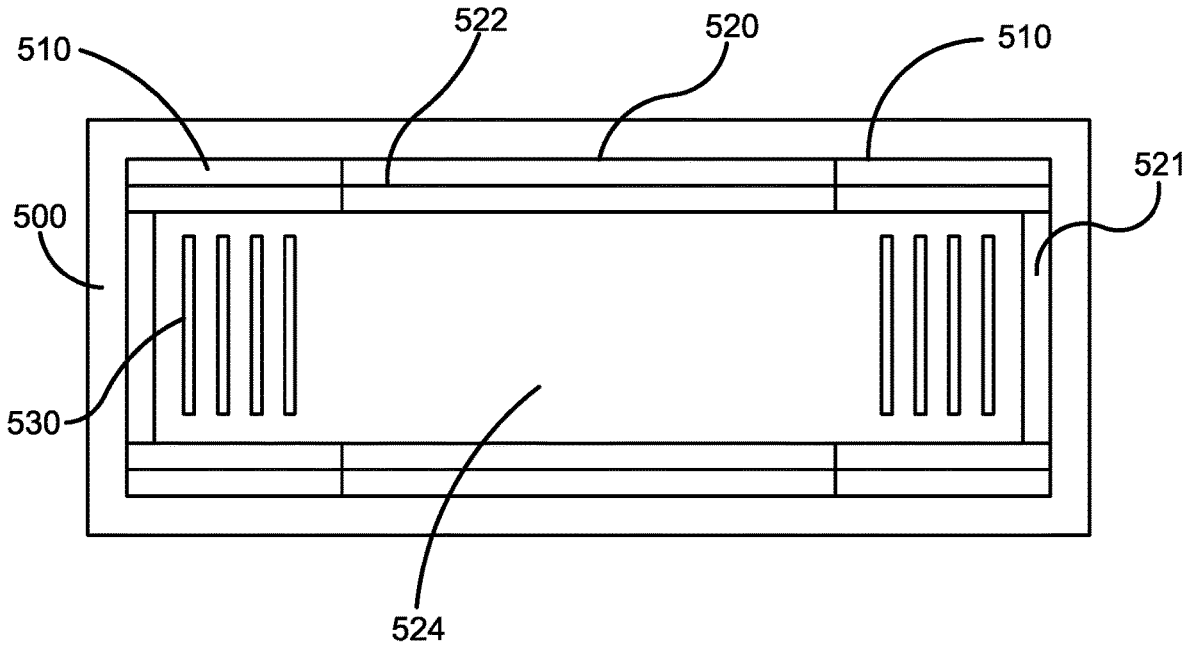
FIG. 5A illustrates a perspective view of one potential embodiment of the strapless personal protection device of the present invention in accordance with the disclosed architecture, wherein the flex zones in the frame and the stretchable areas of the covering material are clearly shown.
Figure 5B:
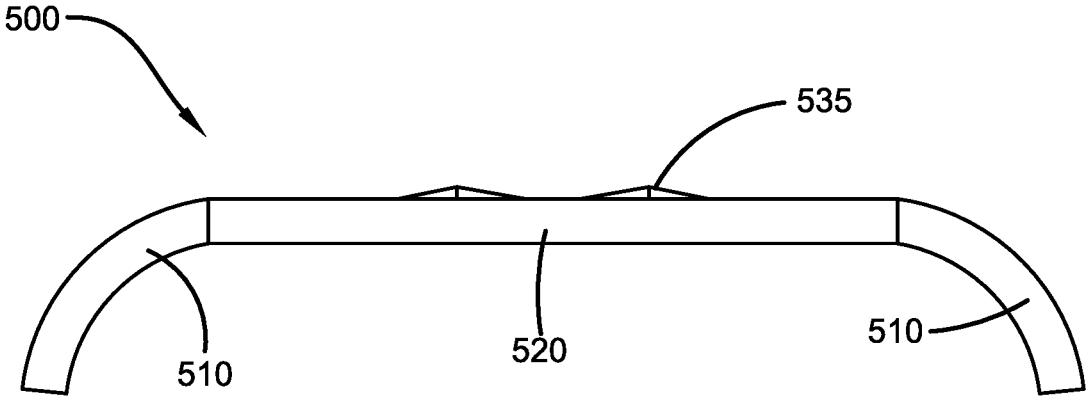
FIG. 5B illustrates a side perspective view of the strapless personal protection device depicted in FIG. 5A.

FIG. 5A illustrates a perspective view of one potential embodiment of the strapless personal protection device 500 of the present invention in accordance with the disclosed architecture, wherein the flex zones 510 in the frame 520 and the stretchable areas of the covering material are clearly shown. More specifically, the central frame 520 includes side frame elements 521. Each of the zones 510 is capable of bending or flexing to the particular curvature of the face to which it is to be applied, while the main frame portion 520 remains fixed. The covering 524 also has stretchable areas 530 which cooperate with the flex zones 510 such that the covering stretches with the frame and continues to cover the face of the individual. The cords 522 are shown as extending through both the frame 520, the flex zones 510 and also extend through the side frame elements 521. FIG. 5B illustrates a side perspective view of the strapless personal protection device 500 depicted in FIG. 5A, wherein the flex zones 510 are shown bent or flexed from the frame 520 to provide a conforming fit to the face of the individual wearer. Also shown in FIG. 5B are the three-dimensional elements 535 affixed to the front of the face mask 500.

Figure 6:
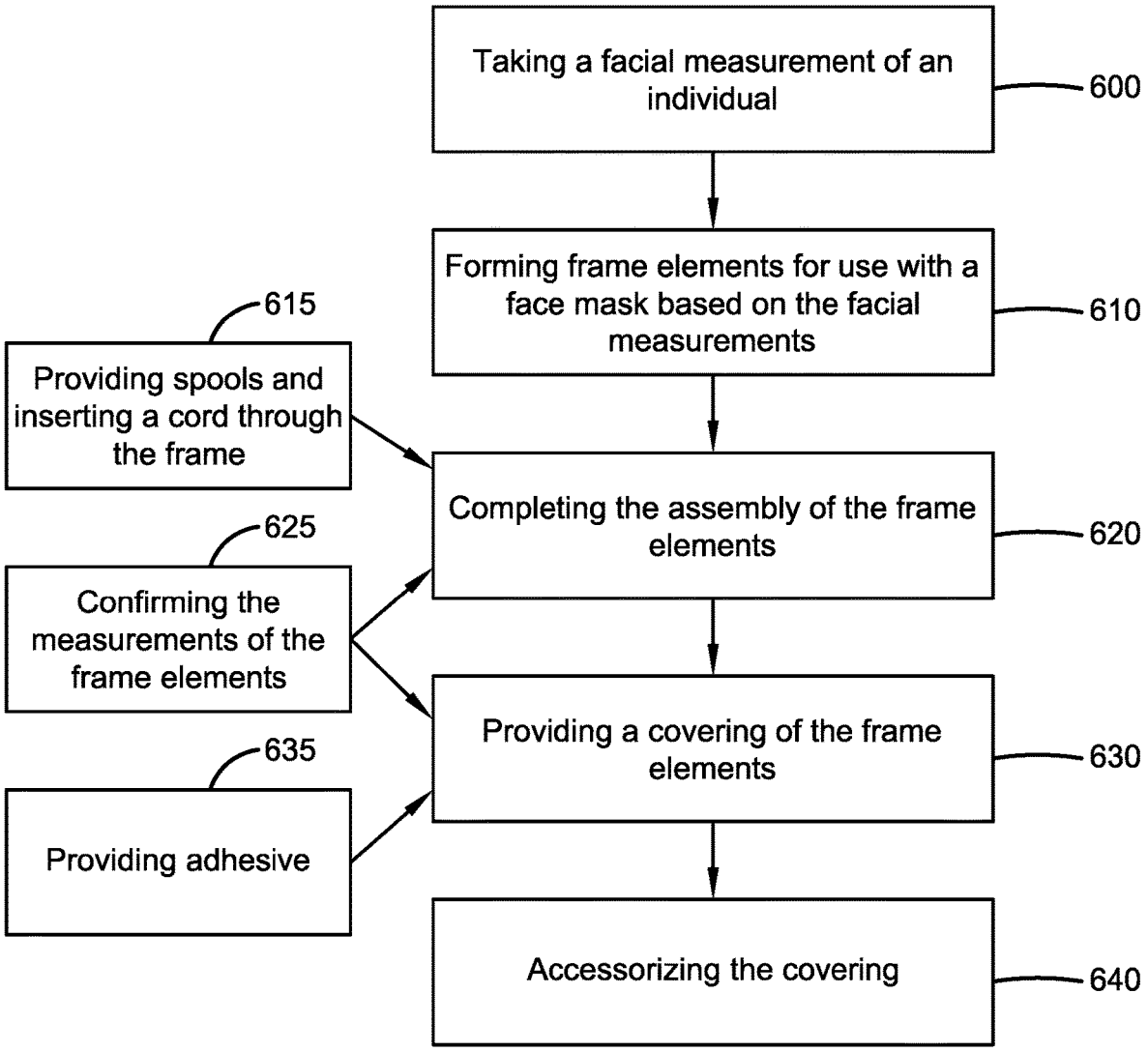
FIG. 6 illustrates a block diagram of one potential method of making the strapless personal protection device of the present invention in accordance with the disclosed architecture.

FIG. 6 illustrates a block diagram of one potential method of making the strapless personal protection device of the present invention in accordance with the disclosed architecture. More specifically, the method begins with taking facial measurements at step 600, and then forming the frame elements at step 610 based on the measurements. Then, at step 620, the assembly of the strapless mask is completed. A covering is provided at step 630, and the cover is accessorized at step 640. A spool may be provided at step 615 and a cord can be inserted into the frame. In a further step at 625, the frame elements can be confirmed in accordance with the measurements, and a hypoallergenic adhesive or adhesive tape may be provided at step 635.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "strapless face mask device", "mask", and "device", are interchangeable and refer to the strapless face mask device 100, 500 of the present invention.

Notwithstanding the forgoing, the strapless face mask device 100, 500 of the present invention and its various components can be of any suitable size and configuration as is known in the art without affecting the overall concept of the invention, provided that they accomplish the above-stated objectives. One of ordinary skill in the art will appreciate that the size, configuration and material of the strapless face mask device 100, 500 as shown in the FIGS. are for illustrative purposes only, and that many other sizes and shapes of the strapless face mask device 100, 500 are well within the scope of the present disclosure. Although the dimensions of the strapless face mask device 100, 500 are important design parameters for user convenience, the strapless face mask device 100, 500 may be of any size, shape and/or configuration that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A personal protection device comprising:

a frame having at least one hollow horizontal member and at least one vertical member;

a covering for the frame, the covering extending over the at least one hollow horizontal member and at least one vertical member;

a cable running through the at least one hollow horizontal member; and a first device for tightening and loosening the frame for the frame to fit on a surface of a face of an individual, wherein the first device adjusts the length of the cable through at least a spool, wherein the frame is flexible and configured to fit the surface of the face;

wherein the at least one hollow horizontal member and the at least one vertical member are connected via a hinge; and wherein the personal protection device is configured to secure to the surface of the face without looping around the back of the individuals head and/or ears.

2. The personal protection device as recited in claim 1, wherein the first device further comprises a central shaft, a plurality of gears, and a dial head or controller.

3. The personal protection device as recited in claim 1, wherein the covering comprises a plurality of pockets for holding the at least one hollow horizontal member and the at least one vertical member.

4. The personal protection device as recited in claim 1, wherein the first device is provided on each side of the frame.

5. The personal protection device as recited in claim 1, wherein an adhesive or an adhesive tape is used to secure the personal protection device to the surface of the face.

6. The personal protection device as recited in claim 5, wherein the adhesive is a hypoallergenic adhesive.

7. A face mask comprising:

a flexible frame comprised of at least one hollow horizontal member and at least one vertical member;

a covering extending over the flexible frame to provide a protective covering for a surface of a wearer;

a cable running through the at least one hollow horizontal member;

a tightening mechanism located on each side of the flexible frame and connected to the cable;

wherein the tightening mechanism adjusts the length of the cable to tighten and loosen the frame;

wherein each tightening mechanism comprises a circular body housing a spool, wherein the spool comprises a top surface, a plurality of spool gears, a middle surface, a bottom surface and a center shaft running through the top, middle, and bottom surfaces; and wherein the center shaft comprises a plurality of locking gears configured to engage the plurality of spool gears to lock the center shaft in a position;

wherein the at least one hollow horizontal member comprises a plurality of shuttered openings that open and close as the cable is tightened and loosened; and wherein the personal protection device is configured to secure to the surface of the face without looping around the back of the wearers head and/or ears.

8. The face mask as recited in claim 7 further comprising a hypoallergenic adhesive tape applied to the frame to secure the flexible frame to the surface of the wearer.

9. The face mask as recited in claim 7, wherein a portion of the flexible frame is flexible or bendable and a portion of the flexible frame is rigid.

10. The face mask as recited in claim 7, wherein an end portion of the flexible frame is flexible or bendable and a central portion of the flexible frame is rigid.

11. The face mask as recited in claim 7, wherein the covering comprises an indicia, a pattern, a logo, an emblem, an image, a symbol, a design, a letter, a word, a characters, an animal, an advertisement or a combination thereof.

* * * * *